US006394764B1

(12) United States Patent
Samurin

(10) Patent No.: US 6,394,764 B1
(45) Date of Patent: May 28, 2002

(54) GAS COMPRESSION SYSTEM AND METHOD UTILIZING GAS SEAL CONTROL

(75) Inventor: Norman Allen Samurin, Allegany, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 09/539,453

(22) Filed: Mar. 30, 2000

(51) Int. Cl.[7] ..... F04B 23/00; F04B 17/00
(52) U.S. Cl. ..... 417/313; 417/366; 415/11
(58) Field of Search ..... 417/289, 296, 417/299, 300, 301, 307, 308, 309, 313, 366, 369, 370, 372

(56) References Cited

U.S. PATENT DOCUMENTS

| | | | | |
|---|---|---|---|---|
| 3,292,846 A | | 12/1966 | Harper et al. | 230/115 |
| 3,411,702 A | | 11/1968 | Metot et al. | 230/7 |
| 3,685,925 A | | 8/1972 | McJones | 417/302 |
| 3,719,196 A | | 3/1973 | McJones | 137/110 |
| 3,788,776 A | | 1/1974 | Post et al. | 417/295 |
| 4,509,957 A | | 4/1985 | Firey | 48/61 |
| 4,732,123 A | | 3/1988 | Flora | 123/198 |
| 4,831,535 A | | 5/1989 | Blotenberg | 364/431.02 |
| 4,961,260 A | | 10/1990 | Gerri et al. | 29/888.025 |
| 4,971,516 A | | 11/1990 | Lawless et al. | 415/1 |
| 4,993,922 A | | 2/1991 | Lauterbach et al. | 417/279 |
| 5,087,172 A | | 2/1992 | Ferri et al. | 415/230 |
| 5,501,577 A | * | 3/1996 | Cornell et al. | |
| 5,713,724 A | | 2/1998 | Centers et al. | 417/53 |
| 5,765,998 A | * | 6/1998 | Zacharias et al. | 417/423.11 |
| 5,884,494 A | | 3/1999 | Okoren et al. | 62/126 |
| 5,899,667 A | * | 5/1999 | Greer | |
| 5,927,399 A | | 7/1999 | Kazakis et al. | 165/284 |
| 5,971,702 A | | 10/1999 | Afton et al. | 415/126 |
| 6,000,701 A | | 12/1999 | Burgess | 277/412 |
| 6,126,411 A | * | 10/2000 | Flanigan et al. | |

OTHER PUBLICATIONS

International Searching Authority, Patent Cooperation Treaty, Notification of Transmittal of The International Search Report or the Declaration, International Application No. PCT/US01/09876, Aug. 3, 2001, 6 pages.*

* cited by examiner

*Primary Examiner*—Teresa Walberg
*Assistant Examiner*—Thor Campbell
(74) *Attorney, Agent, or Firm*—Haynes and Boone, LLP

(57) ABSTRACT

A gas compression system and method according to which product gas is introduced into and compressed in, a compressor. A portion of the compressed gas is discharged to external equipment, and a portion of the gas is trapped in response to deactivation of the compressor. The trapped gas is passed back to the deactivated compressor.

29 Claims, 1 Drawing Sheet

GAS COMPRESSION SYSTEM AND METHOD UTILIZING GAS SEAL CONTROL

BACKGROUND

This invention relates to a gas seal control system and method for a gas compressor, and, more particularly, to such a system and method according to which a seal gas is applied to a gas seal in the compressor.

Gas compressors are well known, and include a housing for receiving a product gas to be compressed, a shaft rotatably mounted in the housing, and an impeller fixed to the shaft and cooperating with stationary vanes for compressing the gas before the compressed gas is discharged from the housing.

In many of these arrangements, one or more gas seals are often provided around the shaft between the impeller and the respective ends of the shaft for minimizing leakage of the gas from the high pressure area. During operation of the compressor, at least a portion of the product gas from the compressor is introduced to the seals to maintain a high pressure sealing effect. However this product gas often contains foreign matter, such as dirt, iron filings, and other solid particles which can contaminate the seals. Therefore, a seal gas from an external source is sometimes introduced to the seals to prevent possible contamination of the seals. However, the external seal gas, which is usually nitrogen, is relatively expensive and must be stored and transported from the external source to the compressor, which further adds to the cost.

Therefore, what is needed is gas compressor in which relative clean seal gas can be applied to the seals without significantly adding to the cost.

SUMMARY

According to the system and method of an embodiment of the present invention, a product gas is introduced into and compressed in, a compressor. A portion of the compressed gas is discharged to external equipment, and a portion of the gas is trapped in response to deactivation of the compressor. The trapped gas is passed back to the deactivated compressor and functions as a seal gas.

This embodiment enjoys the advantages of utilizing product gas as a seal gas to eliminate the costs associated with a separate seal gas.

DETAILED DESCRIPTION

Figure 1:
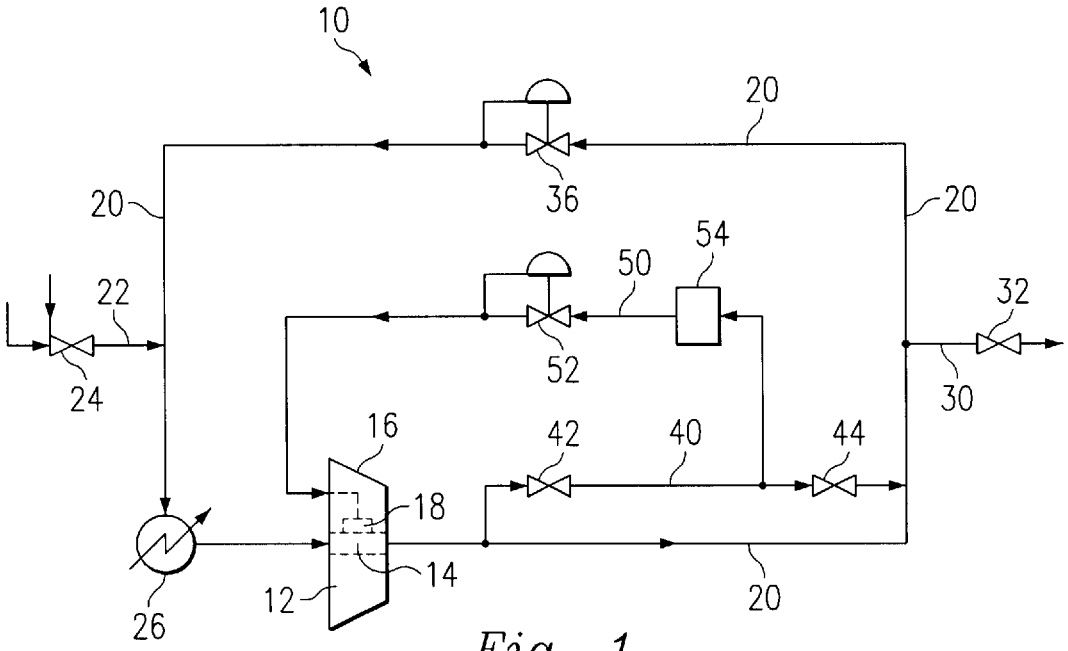
FIG. 1 is a schematic view of a gas compression system according to an embodiment of the present invention.

Referring to FIG. 1 of the drawings, the reference numeral 10 refers, in general, to a gas compression system according to an embodiment of the present invention. The system 10 includes a gas compressor 12 which can be of a convention design and, as such, includes a shaft 14 rotatably mounted in a housing 16. Although not shown in the drawing for the convenience of presentation, it is understood that an impeller is fixed to the shaft 14 and cooperates with stationary vanes for compressing the gas when the compressor 12 is activated in a conventional manner.

A seal 18 is provided on the shaft 14 and extends between the impeller and the upstream end of the shaft. The seal 18 is also of a conventional design and, as such, is adapted to seal against the leakage of the high pressure gas developed by the compressor during its operation and is adapted to receive a high pressure gas in a manner to be described to promote its sealing action. A typical seal of this type includes a rotating member that mounted on the shaft 14 for rotation with the shaft, and a fixed member positioned in very close proximity to the rotating member. One of the seal members, usually the rotating member, has minute indentations or pockets machined in its outer face so that, when it rotates, pressure is created between it and the corresponding face of the other member which separates the two faces. This creates a very small through area through which gas can flow. Examples of these type of seals, or similar seals, are disclosed in U.S. Pat. Nos. 5,441,283; 5,492,341; 5,498,007; 5,700.013; and 5,713,576 the disclosures of all of which are incorporated by reference.

The compressor 12 is connected in a closed loop conduit, shown in general, by the reference numeral 20, extending from the outlet of the compressor and back to its inlet for recycling at least a portion of the compressed gas under conditions to be described. A conduit 22 is connected to the conduit 20 for introducing product gas from an internal source, and at a predetermined pressure, in the direction indicated by the flow arrow under the control of a block valve 24 connected in the conduit 22. The gas then flows through a portion of the conduit 22 to a cooler 26 for the cooling the gas, in a conventional manner.

The relatively cool gas from the cooler 26 is introduced into an inlet of the compressor 12 which operates in a conventional manner to compress the gas to a pressure higher than the inlet pressure utilizing the impeller and vanes discussed above. The compressed gas discharges from the compressor 12 through an outlet and passes back into the conduit 20 downstream of the compressor.

A discharge conduit 30 is connected to the conduit 20 downstream of the compressor 12 for receiving at least a portion of the compressed gas. The conduit 30 discharges the compressed gas to external equipment (not shown) under the control of a valve 32 connected in the conduit. A recycle control valve 36 is connected in the conduit 20 downstream of the conduit 30 for reasons to be described.

A conduit 40 is connected to the conduit 20 just downstream of the outlet of the compressor 12 and extends parallel to a section of the latter conduit. The conduit 40 is connected back to the conduit 20 upstream of the conduit 30. Two spaced block valves 42 and 44 are connected in the conduit 40 and are normally open to permit the flow of some of the compressed gas from the outlet of the compressor 12 into the conduit 40 through which it flows parallel to the flow of the remaining gas through the latter portion of the conduit 20. The block valves 42 and 44 are normally open but can be closed to capture some of the gas in that portion of the conduit 40 extending between them, under conditions to be described.

One end of a conduit 50 is connected to a section of the conduit 40 extending between the block valves 42 and 44. The conduit 50 extends through an inlet of the compressor 12 and to the seal 18. A normally open control valve 52 is connected in the conduit 50 for controlling the flow of gas through the conduit. A filter 54 is also connected in the conduit 50 for filtering foreign matter, such as dirt, iron filings, liquid, etc. from the gas as it passes through the latter conduit under conditions to be described.

In the initial, normal operation of the system 10, the valves 24, 32, 42, 44, and 52 are opened and the valve 36 is closed. Product gas, at a predetermined inlet pressure, is introduced into the conduit 22 for passage to the conduit 20, through the cooler 26, and into the compressor 12. The compressor 12 is activated by turning on its motor switch, or the like, to compress the gas to a pressure above the inlet pressure, and the compressed gas exits the compressor outlet and passes back into, and flows through, the conduit 20. Since the valves 42 and 44 are open, some of this gas passes from the conduit 20 into the conduit 40 through which it flows parallel to the flow of the remaining gas through the corresponding, parallel portion of the conduit 20. A portion of this gas passes from the conduit 40, into and through the conduit 50, and through the filter 54 under the control of the valve 52. The gas is cleaned in the filter 54 in the manner discussed above, exits the filter 54 and passes through the open control valve 52 and to the seal 18 in the compressor 12. This clean gas functions to prevent pressure loss and to keep the dirty process gas out of the area between the faces of the seal 18 to minimize contamination of the seal.

The remaining portion of the gas in the conduit 40 is reintroduced into the conduit 20 and thus mixes with the gas flowing through the latter portion of the conduit. This mixed gas then passes from the conduit 20, into the conduit 30, and passes through the open valve 32 to external equipment for further processing or use.

There are certain conditions when it is desired to recycle at least some of the compressed gas from the compressor 12. For example, design requirements may require that the gas discharged from the conduit 30 must be at a relatively low flow, in terms of cubic feet per minute, for example, which flow is lower than the lowest flow that is possible from the compressor 12. In this case, the valves 42, 44, and 52 are open to permit gas flow through the conduits 40 and 50 as discussed above. The valve 36 is opened and the valve 32 is set at a position to output gas from the conduit 20 at the relatively low flow. Thus, the portion of the gas outputted by the compressor 12 in the conduit 20 that does not flow into the conduit 30 is recycled back through the conduit 20, the open valve 36, and to the cooler 26 for passage back to the compressor 12. The remaining gas needed to meet the minimum output flow of the compressor 12 is supplied from the incoming process gas through the conduit 22, as discussed above. This recycle loop can also be used during start up and shut down of the system 10.

When the compressor 12 is deactivated by the tripping off of its motor, either on purpose to shut down the system, or due to an electrical or system failure, or the like, the valves 24, 32, 42 and 44 are closed and the valve 36 is opened. This can be done automatically in a conventional manner in response to the tripping off of the motor. The closing of the valves 24 and 32 isolates the system 10 from the flow of the process gas into, and the discharge of the gas from, the conduit 20 and the inlet and discharge gas pressure from the compressor are thus the same. The opening of the valve 36 allows any gas remaining in the system to recycle back through the remaining portion of the conduit 20 to the compressor 12.

According to a feature of the invention, the closing of the valves 42 and 44 in response to the tripping of the compressor motor discussed above traps the gas in that section of the conduit 40 extending between the latter valves. This trapped gas is at the same pressure and temperature as the gas discharging from the compressor 12, and the open valve 52 allows the latter gas to flow, at a pressure that is above the inlet pressure of the compressor 12, through the filter 54. Foreign matter is removed from the gas in the filter 54 and the clean gas then passes to the gas seal 18 in the compressor 12 to prevent the dirty process gas from contaminating the gas seal and prevents any pressure loss, as discussed above.

The system 10 thus enables relatively clean process gas to be introduced to the gas seal 18 in the compressor 12 after shut down of the compressor without incurring the expense of providing clean gas from an external source.

Figure 2:
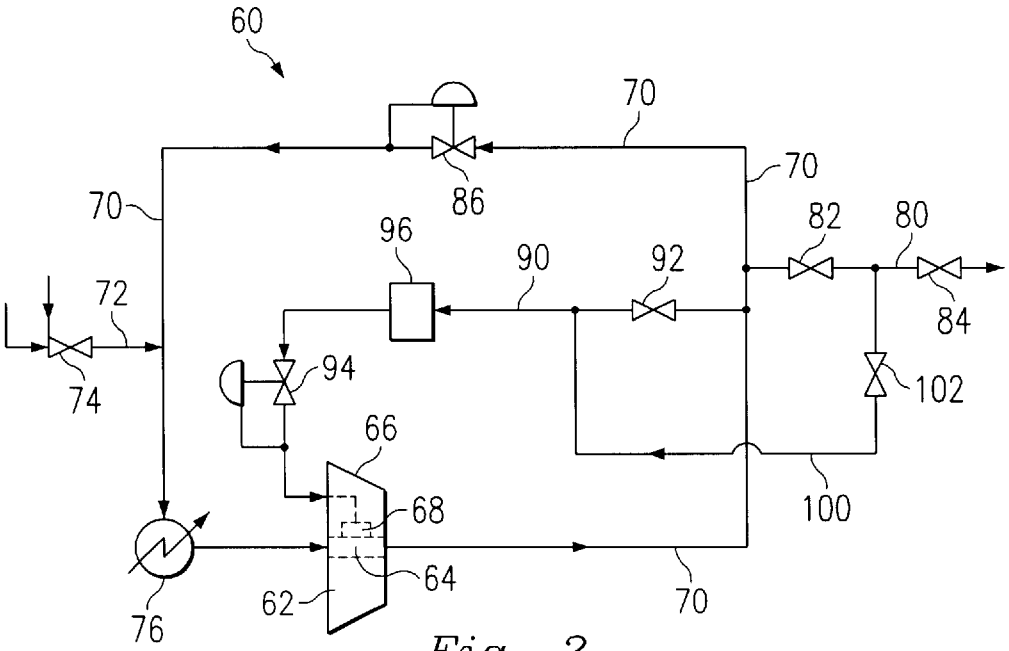
FIG. 2 is a schematic view of a gas compression system according to an alternate embodiment of the present invention.

Referring to the alternate embodiment depicted in FIG. 2 of the drawings, the reference numeral 60 refers, in general, to a gas compression system according to another embodiment of the present invention. The system 60 includes a gas compressor 62 which can be of a convention design and, as such, includes a shaft 64 rotatably mounted in a housing 66. Although not shown in the drawing for the convenience of presentation, it is understood that an impeller is fixed to the shaft 64 and cooperates with stationary vanes for compressing the gas when the compressor 62 is activated in a conventional manner.

A seal 68 is provided on the shaft 64 and extends between the impeller and the upstream end of the shaft. Since the seal 68 is identical to the seal 18 of the previous embodiment, it will not be described in any further detail.

The compressor 62 is connected in a closed loop conduit, shown in general, by the reference numeral 70, extending from the outlet of the compressor and back to its inlet for recycling at least a portion of the compressed gas under conditions to be described. A conduit 72 is connected to the conduit 70 for introducing product gas from an internal source and at a predetermined pressure in the direction indicated by the flow arrow under the control of a block valve 74 connected in the conduit 72. The gas then flows through a portion of the conduit 72 to a cooler 76 for the cooling the gas, in a conventional manner.

The relatively cool gas from the cooler 76 is introduced into an inlet of the compressor 62 which operates in a conventional manner to compress the gas to a pressure higher than the inlet pressure utilizing the impeller and vanes discussed above. The compressed gas discharges from the compressor 62 through an outlet and passes back into the conduit 70 downstream of the compressor.

A discharge conduit 80 is connected to the conduit 70 downstream of the compressor 62 for receiving at least a portion of the compressed gas, under conditions to be described, and discharging the compressed gas to external equipment (not shown). A pair of spaced block valves 82 and 84 are provided in the conduit 80 for controlling the flow of the gas through the conduit. The block valves 82 and 84 can be closed to capture some of the gas in that portion of the conduit 80 extending between the block valves 82 and 84, as will be described.

A recycle control valve 86 is connected in the conduit 70 downstream of the conduit 80 for controlling the flow of gas through the latter conduit under conditions to be described.

One end of a conduit 90 is connected to the conduit 70 at a point just upstream of the connection of the conduit 80 to the conduit 70. The conduit 90 extends from the conduit 70, through an inlet of the compressor 62, and to the seal 68. A pair of spaced valves 92 and 94 are provided in the conduit 90 for controlling the flow of gas through the latter conduit, and a filter 94 is also connected in the conduit 90 between the latter valves for filtering foreign matter, such as dirt, iron filings, liquid, etc. from the gas as it passes through the conduit 90.

A conduit 100 extends from the conduit 80 between the valves 82 and 84 to the conduit 90 just downstream of the valve 92. A block valve 102 is connected in the conduit 90 for controlling the flow of gas from the conduit 80 to the conduit 90 under conditions to be described.

In the initial, normal operation of the system 60, the valves 86 and 102 are closed and the valves 72, 82, 84 92, and 94 are opened. Product gas, at a predetermined inlet pressure, is introduced into the conduit 72 for passage to the conduit 70, through the cooler 76, and into the compressor 62. The compressor 62 is activated by turning on its leg motor switch, or the like, to compress the gas to a pressure above the inlet pressure, the compressed gas exits the compressor outlet and passes back into, and flows through, the conduit 70.

Since the valves 82, 84, 92 and 94 are open, some of the compressed gas from the compressor 62 passes from the conduit 70, into the conduit 80, and passes through the open valves 82 and 84 and discharges from the system 60 for passage to external equipment for further processing or use. Another portion of the compressed gas from the compressor 62 passes from the conduit 70, into the conduit 90, and into and through the open valve 92 and the filter 96 under the control of the valve 94. The filter 96 operates to clean the gas as discussed above, and the relatively clean gas passes to the seal 68 in the compressor 62. The relatively clean gas functions to prevent pressure loss and to keep the dirty process gas out of the area between the faces of the seal 68 and thus minimizes contamination of the seal.

If it is desired to recycle at least some of the compressed gas from the compressor 62, for the reasons set forth above in connection with the embodiment of FIG. 1, the valves 92 and 94 are opened to permit the flow through the conduit 90 as described above., The valves 82 and 84 are set at a position to output gas from the conduit 70 at a relatively low flow rate and the valve 86 is opened. This permits the remaining portion of the gas in the conduit 70 downstream of the conduit 90 to be recycled back through the valve 86 to the cooler 76 for passage back to the compressor 62. The remaining gas needed to meet the minimum output flow of the compressor 62 is supplied from the incoming process gas through the conduit 72, as discussed above. This recycle loop can also be used during start up and shut down of the system 60.

When the compressor 12 is deactivated by the tripping off of its motor, either on purpose to shut down the system, or due to an electrical or system failure, or the like, the valves 74, 82, 84 and 92 are closed and the valves 86, 94, and 102 are opened. This can be done automatically in response to the tripping off of the motor in a conventional manner. The closing of the valves 74, 82 and 84 isolates the system 60 from the flow of the process gas into, and the discharge of the gas from, the conduit 70 and the inlet and discharge gas pressure from the compressor are the same. The opening of the valve 86 allows any gas remaining in the system to recycle back through the remaining portion of the conduit 70 to the compressor 62.

According to a feature of the invention, when the valves 82 and 84 close as a result of the shut off of the motor of the compressor 68 as described above, some of the gas in that section of the conduit 80 extending between the latter valves is trapped. This gas, which is at the same temperature and elevated pressure as the gas discharging from the compressor 62, then flows through the open valve 102, into the conduit 90 downstream of the valve 92, and into the filter 96. Foreign matter is removed from the gas by the filter 96 before the clean gas flows through the open valve 94 and to the gas seal 68 in the compressor 62 to prevent pressure loss and possible contamination of the seal by the process gas in the compressor, as discussed above.

Thus the embodiment of FIG. 2 enjoys all of the advantages of the embodiment of FIG. 1.

It is understood that variations may be made to each of the above embodiments without departing from the scope of the invention. For example, more than one gas seal be provided in the compressor and any other type of device, other than a filter can be used to clean the gas. Further, although the flow lines were referenced as being in the form of "conduits" it is understood that any type of flow line can be used.

Since other modifications, changes, and substitutions are intended in the foregoing disclosure, it is appropriate that the appended claims be construed broadly and in a manner consistent with the scope of the invention.

What is claimed is:

1. A gas compression system comprising a compressor for receiving product gas and compressing the gas, a first conduit for receiving compressed gas from the compressor, a second conduit for receiving some of the compressed gas and trapping the latter gas when the compressor shuts down, a third conduit connecting the second conduit to the compressor for passing the trapped gas back to the compressor, and a cleaning device disposed in the third conduit for cleaning the trapped gas before it is passed to the compressor.

2. The system of claim 1 further comprising two spaced valves in the second conduit, the valves being movable from an open position in which gas flows through the second conduit to the third conduit, and a closed position in which gas is trapped in the second conduit between the valves.

3. The system of claim 2 wherein the valves are open during operation of the compressor and closed when the compressor shuts down.

4. The system of claim 3 wherein the trapped gas passes from the second conduit to the third conduit for passage back to the compressor after the compressor shuts down.

5. The system of claim 1 further comprising a gas seal disposed in the compressor and wherein the clean gas passes from the third conduit to the gas seal.

6. The system of claim 1 wherein the second conduit receives some of the compressed gas from the first conduit.

7. The system of claim 1 further comprising a fourth conduit connected to the first conduit for discharging the compressed gas in the first conduit from the system.

8. The system of claim 7 wherein the fourth conduit discharges a portion of the compressed gas and wherein the first conduit is connected to the inlet of the compressor for passing another portion of the gas back to the compressor.

9. The system of claim 1 further comprising a fourth conduit connected to the second conduit for discharging the compressed gas in the first conduit from the system.

10. The system of claim 9 wherein the fourth conduit discharges a portion of the compressed gas and wherein the first conduit is connected to the inlet of the compressor for passing another portion of the gas back to the compressor.

11. The system of claim 1 wherein the compressor has an inlet for receiving the gas from an external source, and an outlet for discharging the compressed gas, the first conduit connected to the inlet and the outlet of the compressor for receiving compressed gas from the outlet; passing the gas in a loop, and returning the gas back to the inlet.

12. A gas compression system comprising a compressor having an inlet for receiving product gas and an outlet for discharging the compressed gas; a first conduit connected to the outlet for receiving compressed gas; a second conduit connected to the first conduit for discharging at least a portion of the gas from the system; a third conduit connected to the first conduit for receiving some of the compressed gas and trapping the latter gas when the compressor shuts down; a fourth conduit connecting the third conduit to the compressor for passing the trapped gas back to the compressor when the compressor shuts down, and a cleaning device disposed in the fourth conduit for cleaning the trapped gas before it is passed to the compressor.

13. The system of claim 12 further comprising two spaced valves in the third conduit, the valves being movable from an open position in which gas flows through the third conduit back to the first conduit, and a closed position in which gas is trapped in the third conduit between the valves.

14. The system of claim 13 wherein the valves are open during operation of the compressor and closed when the compressor shuts down.

15. The system of claim 14 wherein the trapped gas passes from the third conduit to the fourth conduit for passage back to the compressor after the compressor shuts down.

16. The system of claim 12 further comprising a gas seal disposed in the compressor and wherein the clean gas passes from the fourth conduit to the gas seal.

17. The system of claim 12 wherein the first conduit is also connected to the inlet of the compressor and passes a portion of the gas in a loop before returning the gas back to the inlet.

18. A gas compression system comprising a compressor having an inlet for receiving product gas and an outlet for discharging the compressed gas; a first conduit connected to the outlet for receiving compressed gas; a second conduit connected to the first conduit for discharging at least a portion of the gas from the system; a third conduit connected to the second conduit for receiving some of the compressed gas and trapping the latter gas when the compressor shuts down; a fourth conduit connecting the third conduit to the compressor for passing the trapped gas back to the compressor when the compressor shuts down, and a cleaning device disposed in the fourth conduit for cleaning the trapped gas before it is passed to the compressor.

19. The system of claim 18 further comprising two spaced valves in the third conduit, the valves being movable from an open position in which gas flows through the third conduit back to the second conduit, and a closed position in which gas is trapped in the third conduit between the valves.

20. The system of claim 19 wherein the valves are open during operation of the compressor and closed when the compressor shuts down.

21. The system of claim 20 wherein the trapped gas passes from the third conduit to the second conduit for passage back to the compressor after the compressor shuts down.

22. The system of claim 18 further comprising a gas seal disposed in the compressor and wherein the clean gas passes from the fourth conduit to the gas seal.

23. The system of claim 18 wherein the first conduit is also connected to the inlet of the compressor and passes a portion of the gas in a loop before returning the gas back to the inlet.

24. A gas compression method comprising the steps of introducing product gas into a compressor, activating the compressor for compressing the gas in the compressor, receiving the compressed gas and discharging a portion of the compressed gas to external equipment, recycling a portion of the compressed gas to the inlet of the compressor, trapping a portion of the compressed gas in response to deactivation of the compressor, cleaning the trapped gas, and passing the trapped gas back to the deactivated compressor.

25. The method of claim 24 wherein the trapped gas is passed to a gas seal in the compressor to prevent product gas being compressed from entering the gas seal.

26. The method of claim 24 wherein the step of trapping comprising the steps of providing a conduit for receiving a portion of the compressed gas during operation of the compressor, connecting two spaced valves in the conduit and closing the valves when compressed gas is in the conduit.

27. The method of claim 26 wherein the valves are normally open to permit compressed gas to flow through the conduit and wherein the valves are closed when the compressor is deactivated to trap the gas.

28. The method of claim 27 wherein the step of passing comprising the steps of opening the valves to allow the trapped gas to pass back to the deactivated compressor.

29. The method of claim 24 further comprising the step of recycling a portion of the compressed gas back to the inlet of the compressor.

* * * * *